US009042752B2

(12) United States Patent
Noguchi

(10) Patent No.: US 9,042,752 B2
(45) Date of Patent: May 26, 2015

(54) IMAGE FORMING APPARATUS

(71) Applicant: CANON KABUSHIKI KAISHA, Tokyo (JP)

(72) Inventor: Bunro Noguchi, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/743,762

(22) Filed: Jan. 17, 2013

(65) Prior Publication Data

US 2013/0188974 A1 Jul. 25, 2013

(30) Foreign Application Priority Data

Jan. 25, 2012 (JP) ..... 2012-013202

(51) Int. Cl.
*G03G 15/00* (2006.01)
*G03G 15/02* (2006.01)

(52) U.S. Cl.
CPC ..... *G03G 15/0266* (2013.01)

(58) Field of Classification Search
CPC ..... G03G 15/0266
USPC ..... 399/38, 46, 50, 89
See application file for complete search history.

(56) References Cited

U.S. PATENT DOCUMENTS 8,170,433 B2 * 5/2012 Kubo ..... 399/50
2010/0239286 A1 * 9/2010 Hanashi ..... 399/50

FOREIGN PATENT DOCUMENTS

JP 3902974 B2 4/2007
JP 3903019 B2 4/2007

* cited by examiner

*Primary Examiner* — Christopher Mahoney
(74) *Attorney, Agent, or Firm* — Canon U.S.A., Inc. IP Division

(57) ABSTRACT

An image forming apparatus performs first control, while rotating an image bearing member at a first speed during non-image-formation, to apply a plurality of alternating-current voltages differing in peak-to-peak voltage to a charging device and to detect the value of each alternating current flowing through the image bearing member. When rotating the image bearing member at a second speed during image formation, the image forming apparatus performs second control, while rotating the image bearing member at the second sped before the start of image formation, to apply an alternating-current voltage determined based on the first control to the charging device. In the second control, the image forming apparatus detects the value of the alternating current flowing through the image bearing member, and determines a peak-to-peak voltage of the alternating-current voltage applied to the charging device at the time of image formation based on the detected alternating current value.

20 Claims, 8 Drawing Sheets

IMAGE FORMING APPARATUS

BACKGROUND OF THE INVENTION

1. Field of the Invention

The present invention relates to an image forming apparatus employing electrophotography, such as a printer or a copying machine.

2. Description of the Related Art

In an image forming apparatus employing electrophotography, a laser beam corresponding to image information is applied to a uniformly charged photosensitive member, thereby forming an electrostatic latent image. Then, developer is supplied to the electrostatic latent image by a developing unit to make the image visible. Further, the image is transferred from the photosensitive member to a recording material, thereby forming an image on the recording material. A contact charging method using a charging device for the photosensitive member is widely adopted. According to the contact charging method, a charging roller is brought into contact with the surface of the photosensitive member, and voltage is applied to the charging roller to thereby charge the surface of the photosensitive member.

The charging bias voltage applied to the charging roller may be solely a direct current voltage. However, in many cases, a bias voltage is employed which is obtained by superimposing an alternating current voltage exhibiting a peak-to-peak voltage (Vpp) equal to or greater than double the discharge start voltage at the start of the application of the direct current voltage on a direct current voltage Vdc corresponding to a desired dark portion potential Vd on a photosensitive member. This charging method is superior in uniformly charging the surface of the photosensitive member, and helps to clear away local unevenness in potential on the photosensitive member.

When the peak-to-peak voltage is low, faulty charging may be generated. On the other hand, when the peak-to-peak voltage is too high, the roughness on the surface of the photosensitive member may increase, thus resulting in generation of longitudinal streaks on the image. Thus, it is desirable to apply a requisite minimum peak-to-peak voltage high enough not to generate faulty charging. Japanese Patent No. 3902974 discusses a superior method which helps to achieve compatibility between a reduction in power circuit cost and the application of a more suitable charging bias. In this method, a plurality of alternating current voltages differing in peak-to-peak voltage is applied to the photosensitive member, and each alternating current flowing through the photosensitive member is detected, then determining the charging bias at the time of image formation according to a peak-to-peak voltage leading to a minimum electric current value equal to or greater than a reference current. Further, as discussed in Japanese Patent No. 3903019, there is a method according to which the control to determine the charging bias at the time of image formation is conducted during an initial rotation when the power source is turned on. The initial rotation refers to performing an image formation preparing operation while rotating the photosensitive member after turning the power source on. As a result, there is no need to control operation during image formation, so that it is possible to make the period of time elapsing until the image output so much the shorter.

However, in the case of the method as discussed in Japanese Patent No. 3903019, in which the charging bias at the time of image formation is determined through the initial rotation at the time of turning-on of the power source and in which there is a difference in the driving speed of the photosensitive member between the time of initial rotation when the power source is turned on and the time of image formation, the following problem is involved. By way of example, this will be discussed in relation to the case where the driving speed of the initial rotation at the time of turning-on of the power source is lower than the driving speed at the time of image formation. The problem involved in this case lies in the fact that the charging bias determined at the time of initial rotation (at the time of non-image-formation), when the driving speed is low, cannot be applied as it is to the case where the driving speed is high (at the time of image formation). In the case of the charging system in which a bias obtained through superimposition of an alternating current voltage is applied, the frequency of the alternating current voltage applied is increased according to the driving speed, so that the amount of electric current flowing per unit time is made constant, making it possible to effect the charging in a satisfactory manner. Due to the characteristics of the electric circuit, the alternating current voltage waveform may be somewhat changed as a result of the change in the frequency of the charging bias, which also means a change in the alternating current value. Thus, there is the possibility of the charging bias determined when the driving speed is low not being the proper charging bias in the case where the driving speed is high.

To solve this problem, a method is available according to which the control to determine the charging bias is not performed during the initial rotation but immediately before the image formation. However, this method takes so much the more time, resulting in a delay in image output.

SUMMARY OF THE INVENTION

The present invention is directed to an image forming apparatus which, even in a case where there is a difference in the driving speed of the image bearing member between the time when no image is being formed and the time when image formation is being performed, is capable of applying an appropriate charging bias while making the reduction in the time elapsing until the image output as small as possible.

According to an aspect of the present invention, an image forming apparatus configured to form an image on a recording material includes an image bearing member, a charging device configured to contact the image bearing member, a power source capable of outputting a plurality of alternating-current voltages differing in peak-to-peak voltage and configured to apply, to the charging device, a voltage obtained by superimposing an alternating-current voltage and a direct-current voltage on each other, and a control unit capable of rotating the image bearing member at a first speed and at a second speed higher than the first speed, wherein the control unit performs first control to cause the power source to apply the plurality of alternating-current voltages differing in peak-to-peak voltage to the charging device while rotating the image bearing member at the first speed during a non-image-formation period in which the image forming apparatus is forming no image and to detect a value of each alternating current flowing through the image bearing member, wherein, when the image bearing member is to be rotated at the second speed at the time of image formation, the control unit performs second control to cause the power source to apply an alternating-current voltage determined based on the first control to the charging device while rotating the image bearing member at the second speed before image formation is started, and wherein, in the second control, the control unit detects a value of alternating current flowing through the image bearing member, and determines a peak-to-peak voltage of an alternating-current voltage to be applied to the charging device at the time of image formation based on the detected value of the alternating current.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
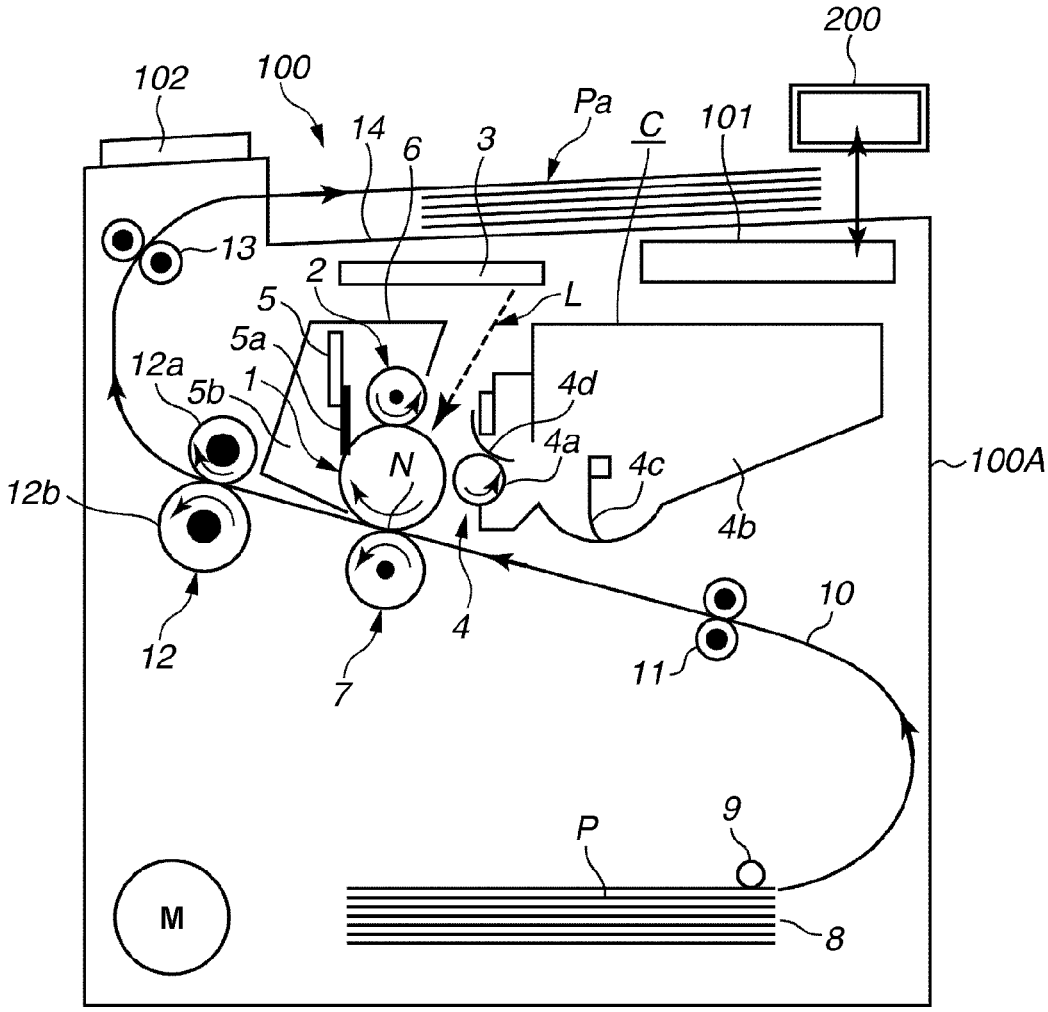
FIG. 1 is a schematic diagram illustrating an image forming apparatus according to a first exemplary embodiment.

FIG. 1 is a schematic sectional view of an image forming apparatus 100 according to the first exemplary embodiment. The image forming apparatus 100 is a process cartridge-detachable-type laser printer employing the transfer type electrophotographic process. That is, it is possible to form an image on a sheet-like recording material P and output the same based on electrical image information input to an engine controller (control unit) 101 from a host apparatus 200. The controller 101 controls the operations of the image forming apparatus 100 in general. The controller 101 causes the image forming apparatus 100 to execute image forming operation according to a predetermined image forming sequence in response to a print command from the host apparatus 200 or an operation unit 102. As described below, the image forming apparatus 100 according to the present exemplary embodiment differs in driving speed between the initial rotation period at the time of power turning-on and the image formation period, the driving speed being higher in the image formation period. As a result, it is possible to suppress operational noise such as drive motor noise during the initial rotation at the time of power turning-on. The host apparatus 200 is a personal computer, an image reader, a facsimile apparatus or the like connected to the controller 101 via an interface.

A process cartridge C is detachably attached to a cartridge attachment mechanism portion (not illustrated) inside an apparatus main body 100A. The cartridge C according to the present exemplary embodiment is formed by mounting a rotary drum type electrophotographic photosensitive member (hereinafter referred to as the drum) 1 as the image bearing member and a process unit acting thereon to a cartridge frame body 6 in a predetermined arrangement relationship. As the process units, there are provided a contact charging device 2, a developing device 4, and a cleaning device 5. The contact charging device 2 is configured to contact the rotating drum 1 to uniformly charge the drum surface to a predetermined polarity/potential. The present exemplary embodiment employs a charging roller configured to be driven to rotate through the rotation of the drum 1. The developing device 4 is a developing unit configured to develop an electrostatic latent image formed on the drum into a developer image (toner image) by developer (toner). The developing device 4 has a developing roller (developer carrying member) 4*a* configured to carry developer and to convey it to a portion (development unit) opposite the drum 1 to develop the electrostatic latent image on the drum.

The developing device 4 has an agitation member 4*c* configured to supply the developing roller 4*a* with developer in a developer storage portion 4*b* while agitating it, a development blade 4*d* configured to regulate the layer thickness of the developer carried by the developing roller 4*a*, etc. The cleaning device 5 is a cleaning unit configured to clean the drum surface by removing adhering residuals such as toner remaining after transfer and paper dust from the surface of the drum 1 after the transfer of the toner image to the recording material P. In the present exemplary embodiment, The cleaning device 5 is a blade cleaning device using a cleaning blade 5*a* as a cleaning member. The residual toner, etc., scraped off from the drum surface by the blade 5*a* is stored in a waste toner storage portion. In the state in which a cartridge C is attached to an apparatus main body 100A in a predetermined manner, an apparatus main body side drive output unit (not illustrated) is connected to a cartridge side drive input unit (not illustrated). Further, an apparatus main body side bias output unit (not illustrated) is connected to a cartridge side bias input unit (not illustrated). As a result, the image forming apparatus 100 can perform image forming operation.

Figure 3A:
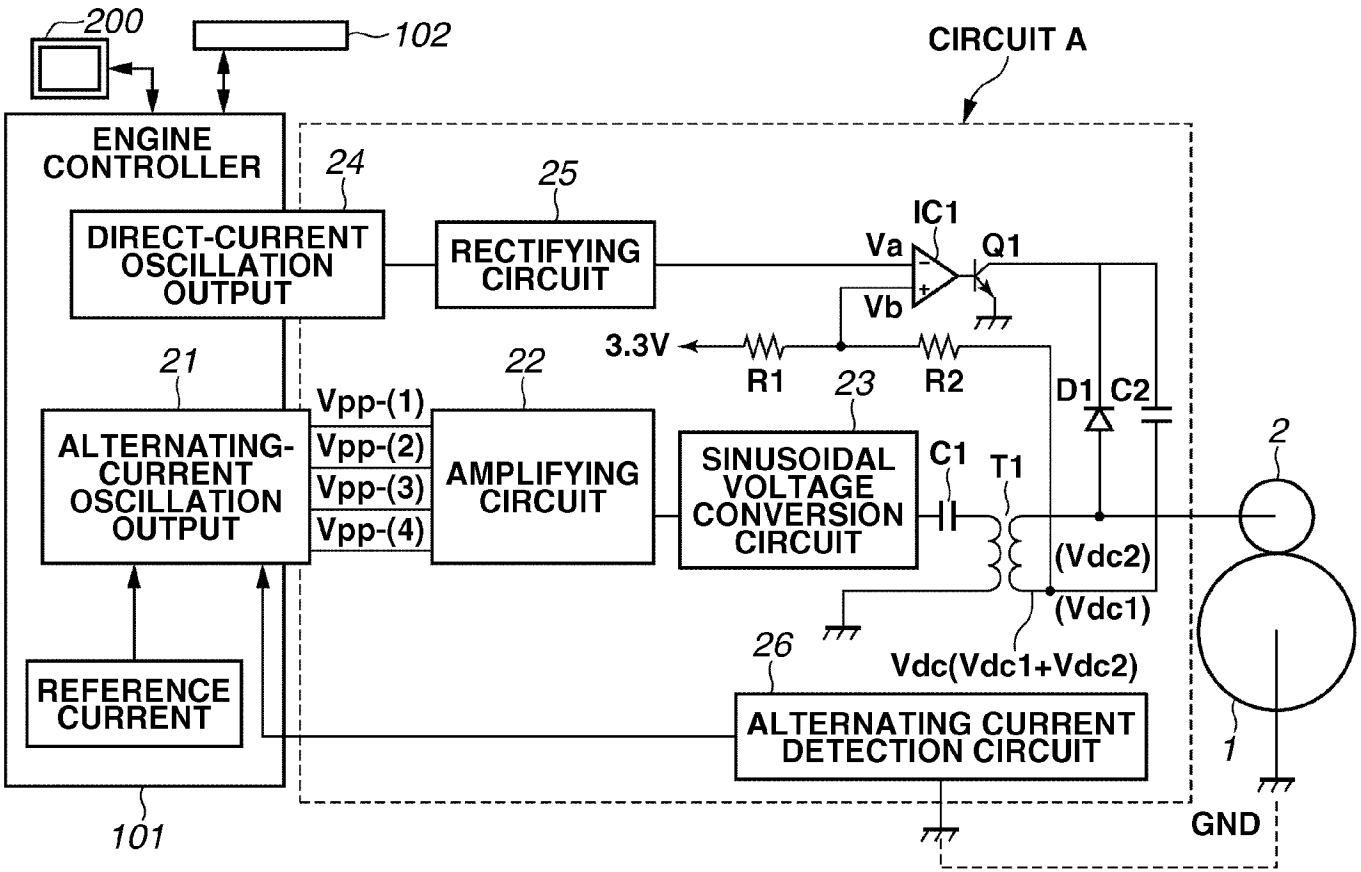
FIG. 3A is a schematic block diagram illustrating a charging bias power source circuit.

Based on the input of a print start signal, the controller 101 starts a drive source (main motor) M, and rotates the drum 1 clockwise as indicated by the arrow at a predetermined driving speed (drum drive-ON). Then, with predetermined control timing, a predetermined charging bias (charging voltage) is applied to the charging roller 2 from a charging bias power source circuit A (FIG. 3A). As a result, the surface of the drum 1 is uniformly charged to a predetermined polarity/potential (dark portion potential Vd). Further, with predetermined control timing, the controller 101 performs image exposure L on the charged surface of the drum 1 by an exposure device (exposure unit) 3. The exposure device 3 according to the present exemplary embodiment is a laser scanner. This device 3 applies a laser beam L modulated based on image information to remove the electric charge of the portion to which the beam is applied (main scanning exposure), forming an electrostatic latent image on the drum surface through the electrostatic constant between the irradiated or bright portion potential V1 and the dark portion potential Vd. Then, the electrostatic latent image is developed into a toner image by the developing device 4.

The toner image formed on the drum 1 is transferred to the recording material P by a transfer roller 7 as the transfer device (transfer unit). The recording materials P are stacked together in a sheet feeding unit 8 and are stored therein. A sheet feeding roller 9 is driven with predetermined control timing, so that one of the recording materials P in the sheet feeding unit 8 is separated and fed, and passes through a sheet path 10 before reaching a registration roller 11. Then, the recording material P is introduced by a roller 11 into a transfer nip portion N, which is a press contact portion between the drum 1 and the roller 7, in synchronization with the toner image on the drum 1, and is conveyed while being pinched. While the recording material P is being conveyed through the nip portion N while being pinched, a transfer bias, which is a DC voltage of a predetermined potential and of a polarity opposite the charging polarity of the toner, is applied to the roller 7 from a transfer bias power source circuit (not illustrated) via a slide contact. As a result, the toner image on the drum 1 is successively transferred electrostatically onto the recording material P. The recording material P having left the nip portion N is separated from the drum 1 and is conveyed to a fixing device (fixing unit) 12. After the separation of the recording material, the residuals on the surface of the drum 1 such as toner and paper dust are removed by the cleaning device 5 for cleaning, and the drum is repeatedly used for image formation. The recording material P conveyed to the fixing device 12 is heated and pressed at a fixing nip portion, which is a press contact portion between a fixing roller 12*a* and a pressure roller 12*b*, so that the unfixed toner image is fixed to the recording material as a fixed image. The recording material Pa after the fixing of the toner image is discharged onto a discharge tray 14 outside the apparatus main body by a discharge roller 13 as an image-formed product (print, copy, etc.).

Figure 2:
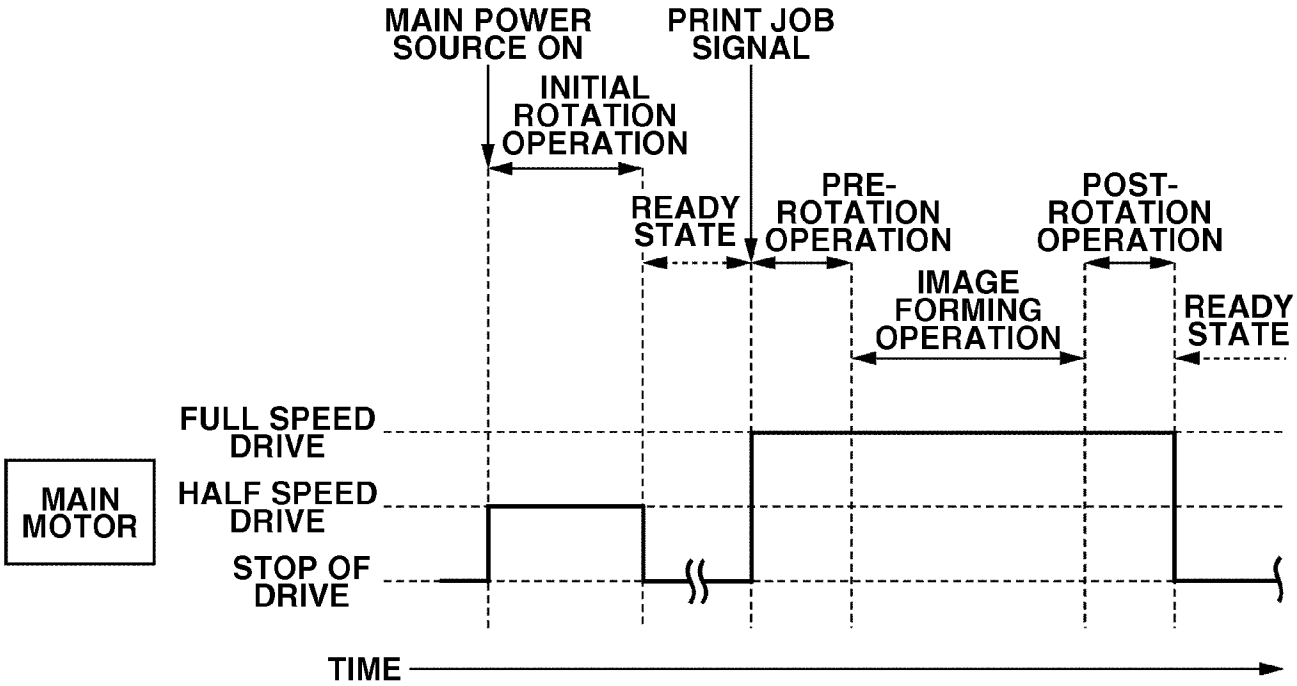
FIG. 2 is an operation process chart for the image forming apparatus according to the first exemplary embodiment.

FIG. 2 is a process chart for the image forming apparatus 100, illustrating the operations to be conducted by the controller 101.

1) Initial rotating operation: the start operation for the image forming apparatus 100. By turning on the main power source switch of the image forming apparatus 100, a main motor M of the image forming apparatus 100 is started to drive the drum 1. When the drum is driven, the operation of preparing a requisite process apparatus is executed. The driving speed of the main motor M at this time is set at 100 mm/sec.

2) Ready state: After the completion of a predetermined initial rotating operation, the driving of the main motor M is stopped, and the image forming apparatus 100 is maintained in a ready (standby) state until a print job signal is input.

3) Pre-rotation (preparatory rotation) operation: Based on the input of the print job signal (signal designating image formation; image signal), the main motor M is re-driven to execute the preparatory rotation operation before image formation. To put it more practically, the operation is performed in the following order: a: the reception of the print job signal by the image forming apparatus 100; b: the development of an image by a formatter; and c: the start of the pre-rotation operation.

4) Image forming operation: When a predetermined pre-rotation (preparatory rotation) process is completed, the above-mentioned image forming process is executed subsequently, and the recording material that has undergone image formation is output.

5) Post-rotation operation: Also after the output of the final recording material that has undergone image formation, the main motor continues to rotate for a predetermined period of time. By doing so, the completion operation after the print job for the requisite process apparatus is executed.

6) Ready state: After the completion of the predetermined post-rotation operation, the driving of the main motor M is stopped, and the image forming apparatus is maintained in a ready state until the next print job signal is input.

Step 1) corresponds to the initial rotation period. Step 3) corresponds to the preparatory rotation period.

In the above sequence, steps 1), 2), 3), 5), and 6) correspond to the non-image-formation period. Steps 3), 4), and 5) are continuous operations, so that they are of the same driving speed. In the present exemplary embodiment, the driving is possible at both 100 mm/sec and 200 mm/sec. The selection of the driving speed at the time of image formation is made by the host apparatus 200 or an operation unit 102. The controller 101 executes image formation at a driving speed corresponding to the selected signal input. Normally, the speed of 200 mm/sec is selected in order to expedite the print output, whereas, in the case of thick paper or highly glossy paper, the speed of 100 mm/sec is selected to enhance the fixing performance. That is, the speed of the drum 1 is variable according to the kind of recording material.

A charging bias applying method according to the present exemplary embodiment will be described. FIG. 3A is a schematic block circuit diagram illustrating a charging bias power source circuit (high voltage power source circuit) A for applying a charging bias to the charging roller 2. The circuit A is equipped with a boosting transformer T1 which is a voltage boosting unit. The boosting transformer T1 can output peak-to-peak voltages in n ($n \geq 3$) stages different from each other: Vpp-(1), . . . , Vpp-(n) (where Vpp-(1)< . . . <Vpp-(n)). Further, it is possible to apply a voltage obtained by superimposing an alternating-current voltage endowed with these peak-to-peak voltages on a direct-current voltage Vdc as the charging bias. In the circuit A of the present exemplary embodiment, it is possible to output four kinds of peak-to-peak voltages Vpp (Vpp-(1)<Vpp-(2)<Vpp-(3)<Vpp-(4)) from an alternating-current oscillation output unit 21 controlled by the controller 101. The output voltage output from the alternating-current oscillation output unit 21 is amplified by an amplifying circuit 22. Then, the voltage is subjected to sinusoidal conversion at a sinusoidal voltage conversion circuit 23, which is composed of an operation amplifier, resistor, capacitor, etc. Then, the direct-current component of the output voltage is reduced to zero via a capacitor C1, and the output voltage is input to the boosting transformer T1, which is a voltage boosting unit. The voltage input to the transformer T1 is boosted to a sinusoidal voltage corresponding to the winding number of the transformer.

On the other hand, the above-mentioned boosted sinusoidal voltage is rectified by a rectifying circuit D1 before peak charge at a capacitor C2. As a result, a constant direct-current voltage Vdc1 is generated. Further, an output voltage determined by printing density, etc., is output from a direct-current oscillation output unit 24 controlled by the controller 101, and is rectified by a rectifying circuit 25 before being input to a negative input terminal of an operation amplifier IC1 as a constant voltage Va. At the same time, a voltage Vb obtained by dividing the voltage at one terminal of the transformer T1 by resistors R1 and R2 is input to a positive terminal of the operation amplifier IC1 to drive a transistor Q1 such that the values of the two voltages (Va and Vb) become equal to each other. As a result, an electric current flows through the resistors R1 and R2 to generate a reduction in voltage, generating a direct-current voltage Vdc2. The above-mentioned direct-current voltages Vdc1 and Vdc2 are added together to thereby obtain a desired direct-current voltage Vdc (Vdc1+Vdc2). An oscillation voltage obtained by superimposing the direct-current voltage Vdc on the above-mentioned alternating current (sinusoidal voltage) is applied to the charging roller 2 as the charging bias. In the system described above, it is only necessary to employ a single transformer T1, which is a voltage boosting unit, whereby it is possible to achieve a reduction in cost regarding the charging bias power source circuit A.

Here, regarding the highest peak-to-peak voltage Vpp-(4), it is necessary for it to be a peak-to-peak voltage involving no faulty charging of the drum 1 in every case. Generally speaking, in the initial stage of use, in which the thickness of the charge transporting layer of the drum 1 is large, and in a low-temperature environment, in which electric current does not easily flow, it is necessary to employ as the peak-to-peak voltage Vpp-(4) a voltage involving no faulty charging even when variation in the charging roller 2 and the applied peak-to-peak voltage are taken into account. On the other hand, when the thickness of the charge transporting layer of the drum 1 has decreased as the image forming apparatus is used, a large electric current flows. In view of this, the other peak-to-peak voltages Vpp-(1), Vpp-(2), and Vpp-(3) are set to be voltages lower than the voltage Vpp-(4). Then, when the thickness of the charge transporting layer of the drum 1 has decreased, switching to the peak-to-peak voltage Vpp-(2), Vpp-(1), etc., is effected, so that no large electric current continues to flow through the drum 1.

Figure 3B:
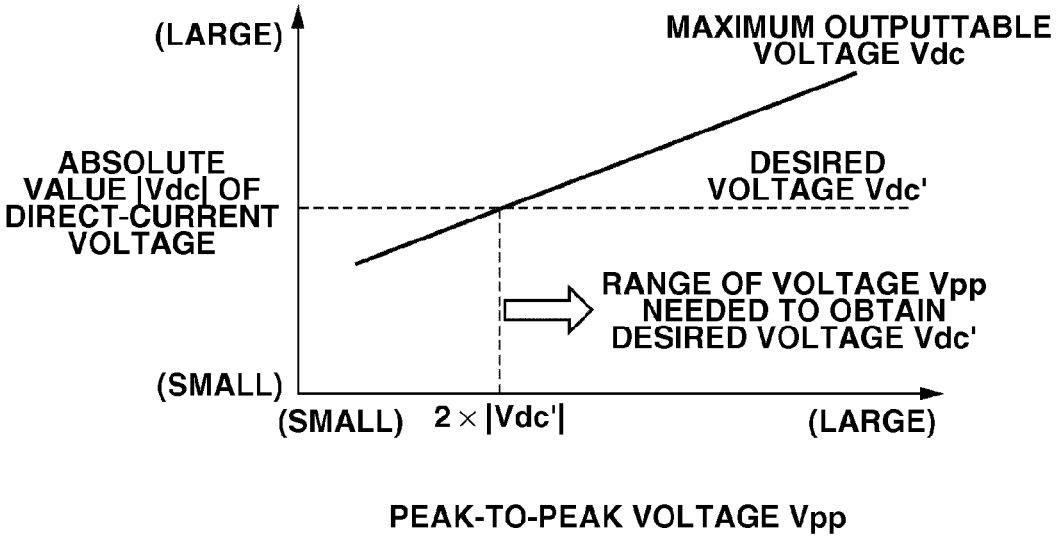
FIG. 3B is a chart illustrating the relationship between applicable peak-to-peak voltage and outputtable direct-current voltage.

Further, in the present system, the direct-current voltage Vdc1 is prepared by using the transformer T1, which is a voltage boosting unit, so that the direct-current voltage Vdc1 is subordinate to the peak-to-peak voltage Vpp. In other words, to obtain the desired direct-current voltage Vdc, it is necessary to charge the capacitor C2 with a fixed level of electric charge by the transformer T1. In FIG. 3B, the horizontal axis indicates the peak-to-peak voltage of an alternating-current voltage, and the vertical axis indicates the value of the maximum direct-current voltage Vdc obtained when the capacitor C2 is charged through the application of a predetermined peak-to-peak voltage. As illustrated in FIG. 3B, when, for example, the desired direct-current voltage is Vdc', the requisite peak-to-peak voltage Vpp of the alternating-current voltage is 2×|Vdc'| or more. To obtain the desired direct current voltage Vdc, it is necessary for the peak-to-peak voltage Vpp to be 2×|Vdc| or more. In the range where the peak-to-peak voltage Vpp is less than 2×|Vdc|, the capacitor C2 is not sufficiently charged, so that it is impossible to obtain the desired direct-current voltage Vdc. Thus, the potential on the drum (drum surface potential, dark portion potential) cannot be charged to a desired value, so that it is impossible to obtain a satisfactory image.

On the other hand, when the electrostatic capacitance of the capacitor C2 is increased, the electric charge amount is increased, making it possible to attain a high direct-current voltage Vdc. In this case, however, the length of the time that the capacitor C2 is charged with electric charge increases, resulting in an increase in the requisite time for the stabilization of the charging waveform. Thus, in the case where the charging of the capacitor C2 is insufficient, unevenness in the potential Vd on the drum may occur.

Thus, in the present example, the minimum value Vpp-(1) of the range where the peak-to-peak voltage Vpp is outputtable is set such that the following relationship with respect to the desired direct-current voltage Vdc holds true: Vpp-(1)≥2×|Vdc|. The voltage Vpp-(1), which is of the least peak-to-peak voltage value, satisfies the following relationship with respect to the superimposed direct-current voltage Vdc: Vpp-(n)=2×|Vdc|, so that it is possible to provide an image forming apparatus capable of achieving a reduction in cost in terms of the power source circuit.

A method for controlling the charging bias will be described with reference to the block schematic diagram of FIG. 3A. A circuit A includes an alternating current detection circuit (charging alternating current detection unit) 26 configured to detect an alternating current Iac flowing through the drum 1 when the charging bias is applied to the charging roller 2.

As first control, the controller 101 successively applies the peak-to-peak voltages in n (n≥4) stages to the charging roller 2 by the circuit A during a part of the initial rotation when the main power source is turned on. The circuit 26 detects the charging alternating current Iac flowing through the drum 1 at this time. The peak-to-peak voltage which has led to the detection of an electric current equal to or greater than the requisite minimum current of the detected Iac and of the least value is stored in memory as Vpp (m).

Then, as second control, the controller 101 applies, at least in a part of the preparatory rotation operation prior to image formation, a peak-to-peak voltage Vpp (m−1) which is equal to the peak-to-peak voltage Vpp (m) stored in the memory or one step lower than the stored peak-to-peak voltage. Then, the alternating current at this time is detected and it is determined whether it is equal to or greater than the minimum requisite current or not.

Here, each of the peak-to-peak voltages applied in the first control and the second control is applied during the period of one rotation of the charging roller, and the value of the electric current flowing through the drum 1 during that one rotation is average-processed to be used as an average value Iac. The reason for doing this is due to variation in the value Iac at the charging roller period due to unevenness in resistance in the charging roller rotational direction. The average-processing is performed in order to eliminate to this variation. Thus, it is necessary for the requisite time for the averaging to correspond to one rotation or more of the charging roller (in the case of a time longer than this, the time may correspond to one rotation of the drum).

Next, the actual charging bias control method will be described. In the case of the image forming apparatus 100 according to the present exemplary embodiment described below, the drum driving speed during the initial rotation at the turning-on of the power source is 100 mm/sec, and the drum driving speed during normal image formation is 200 mm/sec. By making the drum driving speed during the initial rotation lower than that at the time of image formation, it is possible to suppress operational noise such as the drive motor noise during the initial rotation. Here, the low speed adopted for during the initial rotation or at the time of image formation on thick paper will be referred to as V×1 (100 mm/sec), and the high speed adopted for the normal image formation will be referred to as V×2 (200 mm/sec) (V×1 is the first speed, and V×2 is the second speed; V×1<V×2).

The frequency of the charging bias is varied according to the driving speed V×1 or V×2. The frequencies will be referred to as f1 and f2, respectively (f1<f2). In the present exemplary embodiment, f1=750 Hz, and f2=1500 Hz. Even when the driving speed is low, it is possible to adopt the charging frequency f2 for the high speed. However, generally speaking, when the charging frequency is increased, the wear of the drum surface is aggravated, so that, in many cases, the charging frequency is changed according to the driving speed as described above.

Figure 4:
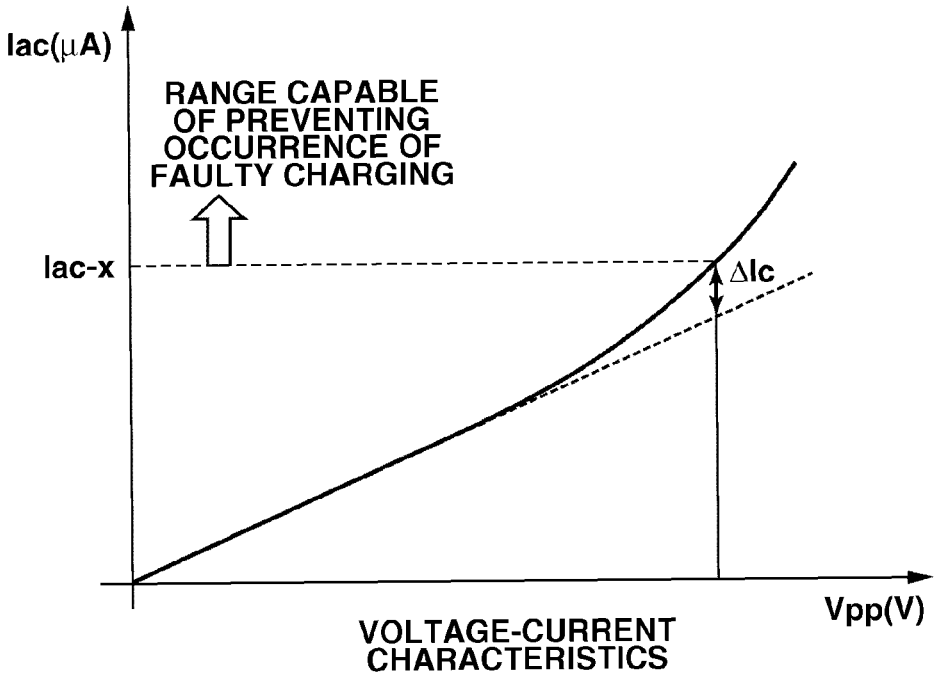
FIG. 4 is a diagram schematically illustrating voltage-current characteristics according to the first exemplary embodiment and a reference current value at which faulty charging ceases to occur.

Here, a method for setting the requisite minimum current described with reference to the above schematic block diagram will be described. FIG. 4 illustrates voltage-current characteristics previously measured before the shipment of the image forming apparatus. The diagram illustrates the relationship between an alternating-current voltage endowed with a predetermined peak-to-peak voltage (Vpp) applied to the charging roller 2 and the alternating current (Iac) flowing through the drum 1. Further, by recording an electric current involving no faulty charging according to the image, it is possible to determine a reference electric current valve (Iac-x) involving no generation of faulty charging. In the present exemplary embodiment, the charging bias is controlled based on the reference current (threshold value current) thus determined. The electric current corresponding to a portion ΔIc in the diagram off the linearity in the voltage-current characteristics is to be regarded as the electric current due to discharge (hereinafter referred to as the discharge current). As is known in the art, it is related to a high degree to the charging property. The reference current is set as an alternating current value providing a predetermined level or more of ΔIc (an alternating current value involving no generation of image defect).

In the case of the present example, there are determined reference alternating current values: Iac-x1 (first threshold value current) and Iac-x2 (second threshold value current) that will lead to a level equal to or greater than an electric current value not involving faulty charging as described below for the driving speeds V×1 and V×2, respectively. The reference electric current value Iac-x varies according to the driving speed of the drum. The driving speed V×1 is half the driving speed V×2, so that Iac-x1 is of a value half that of Iac-x2. However, as described above, the frequency f1 is set to be half the frequency f2. Thus, the alternating current value Iac is so much the smaller by the amount corresponding to the frequency, so that there is no great difference in driving speed between the peak-to-peak voltage Vpp for obtaining Iac-x1 and the peak-to-peak voltage for obtaining Iac-x2. However, due to the characteristics of the alternating-current oscillation circuit, the output waveform somewhat differs as a result of a change in frequency, so that the peak-to-peak voltage Vpp for obtaining the desired reference current Iac-x is not completely of the same value in terms of the driving speed. Further, the alternating-current output waveform varies more or less according to the environment of use of the image forming apparatus, fluctuations in load due to the degree to which the cartridge has been used, etc. Thus, to use an optimum peak-to-peak voltage Vpp, it is desirable to perform control to attain the reference current or more immediately before the image formation, determining the charging bias during the image formation.

Figure 5:
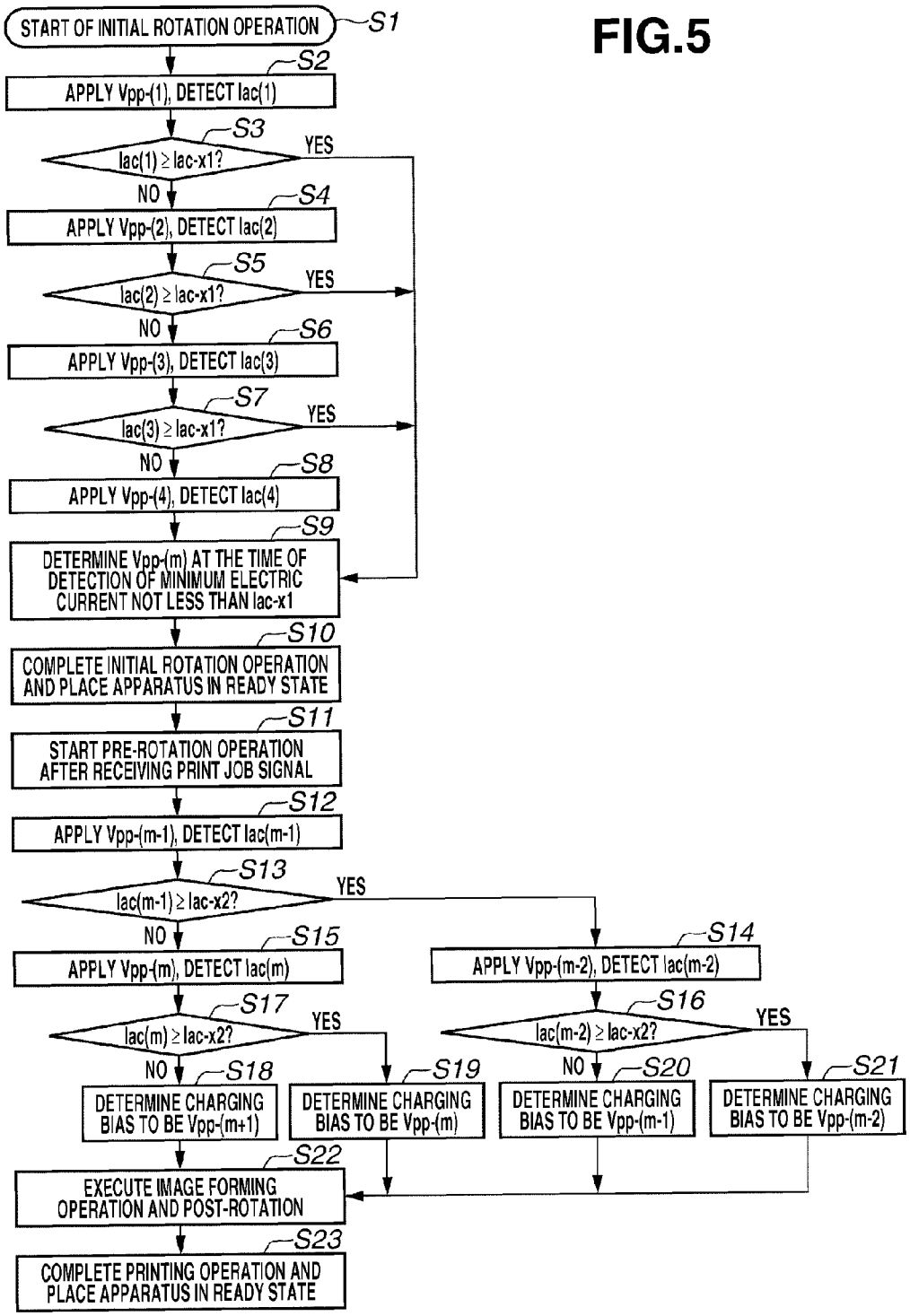
FIG. 5 is a flowchart illustrating a charging bias determining sequence to be performed from the turning-on of the power source to the completion of image formation according to the first exemplary embodiment.

Next, the control performed up to the determination of the charging bias to be used for image formation will be described with reference to the flowchart of FIG. 5.

In step S1, the main power source is turned on, and the initial rotation operation, which is a preparatory operation until the ready state is attained, is started. The driving speed at this time is V×1. In step S2, voltage application is effected starting with the peak-to-peak voltage Vpp-(1), which is the lowest voltage, and the alternating current Iac(1) flowing at that time is measured. In steps S4, S6, and S8, the peak-to-peak voltages Vpp-(2), Vpp-(3), and Vpp-(4) are applied similarly, thereby obtaining the alternating currents Iac(2), Iac(3), and Iac(4). Insteps S3, S5, and S7, the currents Iac(1), Iac(2), Iac(3), and Iac(4) are compared with the reference current value Iac-x1 when the drum driving speed is V×1. Then, in steps S11, S12, S13, and S9, the minimum peak-to-peak voltage Vpp-(n) satisfying the relationship: Iac(n)≥Iac-x1 (n=1, 2, 3, 4) is determined to be Vpp-(m), and is stored in memory. For example, when Iac(3)≥Iac-x1 in the case of the peak-to-peak voltage Vpp-(3) (when n=3), the peak-to-peak voltage Vpp-(m) is determined to be Vpp-(3) (m=3). In the flowchart of FIG. 5, the voltages are successively applied starting with the peak-to-peak voltage Vpp-(1), and, at the stage where the relationship: Iac(n)≥Iac-x1 is satisfied, the alternating-current voltage application is completed to determine the peak-to-peak voltage Vpp-(m). However, this should not be construed restrictively. For example, it is also possible to adopt an arrangement in which all of the peak-to-peak voltages Vpp-(1), Vpp-(2), Vpp-(3), and Vpp-(4) are applied without fail.

Figure 6:
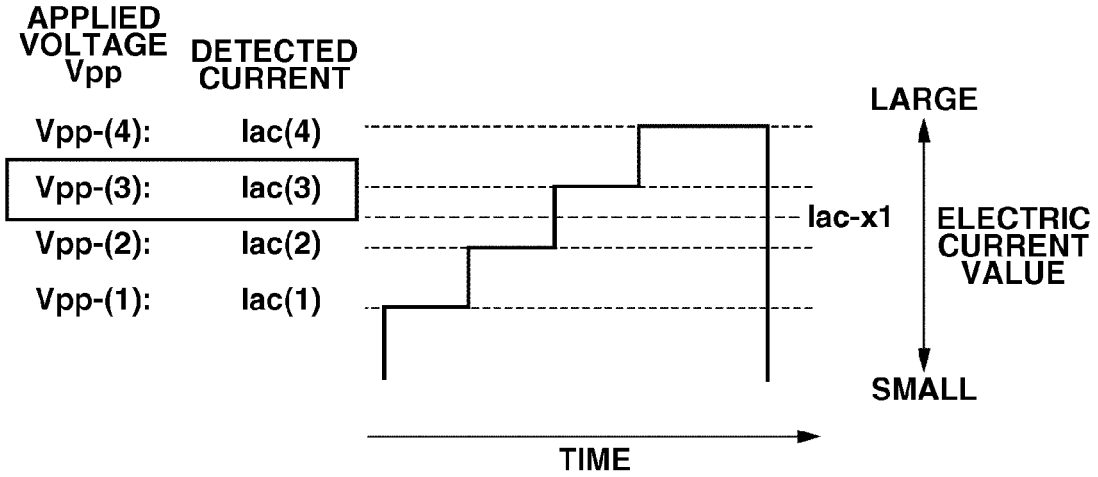
FIG. 6 is a diagram illustrating how charging bias is selected in the charging bias determining sequence according to the first exemplary embodiment.

FIG. 6 illustrates the applied voltages and the appropriate charging bias value selected according to the current value detected. In this case, the value Iac (3) at the time of application of the peak-to-peak voltage Vpp-(3) is larger than the reference current value Iac-x1, and is minimum, so that the peak-to-peak voltage Vpp-(3) is selected as the alternating-current voltage at the time of image forming operation.

Next, the second control sequence when image forming operation is performed immediately after that will be described. In step S11, a print job signal is received, and the pre-rotation (preparatory rotation) operation before the image formation is started. The driving speed at this time may be either V×1 or V×2. Here, the case where the speed V×2, which is the speed at the time of normal image formation, is adopted, will be described. In the case of the speed V×1, the reference current value is Iac-x1. Otherwise, a control operation similar to the second control (this will be referred to as the third control) is conducted.

In step S12, the peak-to-peak voltage Vpp-(m−1) is first applied, and the alternating current Iac(m−1) flowing at that time is measured. Then, in step S13, it is compared with the reference current value Iac-x2. When, in step S14, Iac(m−1) ≥Iac-x2, the peak-to-peak voltage Vpp-(m−2) is applied. In step S16, the alternating current Iac(m−2) detected at that time is compared with the reference current value Iac-x2, and, in step S21, when Iac(m−2)≥Iac-x2, the charging bias applied at the time of image formation is determined to be the peak-to-peak voltage Vpp-(m−2). When, in step S20, Iac(m−2) <Iac-x2, the charging bias is determined to be the peak-to-peak voltage Vpp-(m−1). When, in step S13, Iac(m−1)<Iac-x2, the peak-to-peak voltage Vpp-(m) is applied in step S15. In step S17, the alternating current Iac(m) detected at that time is compared with the reference current value Iac-x2, and, when, in step S19, Iac(m)≥Iac-x2, the charging bias to be applied at the time of image formation is determined to be the peak-to-peak voltage Vpp-(m). When, in step S18, Iac(m) <Iac-x2, the charging bias is determined to be the peak-to-peak voltage Vpp-(m+1). Then, in step S22, image formation is performed by using the charging bias values thus determined, and, in step S23, the printing is completed to restore the apparatus to the ready state.

By determining the charging bias to be used for image formation through the control as described above, the number of peak-to-peak voltages Vpp applied is reduced as compared with that when all the peak-to-peak voltages are applied during the pre-rotation, so that it is possible for the period of time elapsing until the image output to be so much the shorter. The reason for this is that, by performing the first control during the pre-rotation, when there is relatively much time to spare, it is possible to predict the requisite peak-to-peak voltage at the time of image formation. That is, from the alternating current value Iac obtained at the time of the first control, when the drum driving speed is V×1, it is possible to know the requisite peak-to-peak voltage Vpp-(m) when performing image formation at the speed V×1. Then, it is possible to predict that the requisite peak-to-peak voltage for performing image formation at the speed V×2 will also be a value close to the peak-to-peak voltage Vpp-(m). Then, in the second control, it is examined whether it is possible to obtain the desired current value Iac-x2 even in the case of a peak-to-peak voltage not higher than the peak-to-peak voltage Vpp-(m), which serves as the starting point. In the above-described exemplary embodiment, the peak-to-peak voltage Vpp-(m−1) is applied at the start of the second control to determine whether the current obtained is equal to or greater than the second threshold value current or less than the second threshold value current. Then, the alternating-current voltage at the time of image formation is determined based on the alternating-current voltage when the alternating current value is equal to or greater than the second threshold value and when the minimum electric current value is detected. In this way, in the second control, the peak-to-peak voltage of the alternating-current voltage applied to the charging roller is changed to the alternating current value obtained by the first control, so that there is no need to apply all the peak-to-peak voltages Vpp in the second control.

Further, it is also possible to use the minimum peak-to-peak voltage Vpp within the range capable of preventing occurrence of faulty charging, so that it is possible to prevent excessive wear of the drum surface, thus making it possible to provide an image forming apparatus in which image defect is not easily generated for a long period of time.

Further, in the present exemplary embodiment, the peak-to-peak voltage Vpp is applied in four stages in the first control and in two stages in the second control, which means as much peak-to-peak voltage Vpp as possible is applied in the first control, and the peak-to-peak voltage Vpp applied is reduced as much as possible in the second control, so that the effect of the present invention is made more conspicuous. This is for the following reasons: If a lot of peak-to-peak voltages Vpp are allowed to be applied during the pre-rotation, the image output is delayed so much the more. Accordingly, it is desirable to suppress the number of peak-to-peak voltages Vpp to be applied in the second control to a minimum. To do so, it is desirable to obtain information on the charging bias during the initial rotation, in which there is relatively much time to spare.

A feature of the second exemplary embodiment is as follows: In the first exemplary embodiment, two kinds of peak-to-peak voltage Vpp are applied in the second control performed during the pre-rotation, whereas, only one kind of peak-to-peak voltage Vpp is applied in the second exemplary embodiment. The control during the initial rotation is similar to that in the first exemplary embodiment. As a result, it is possible to further shorten the pre-rotation time, making it possible to shorten the period of time elapsing until the image output.

Unless otherwise specified, the construction employed in the second exemplary embodiment is similar to that of the first exemplary embodiment.

Figure 7:
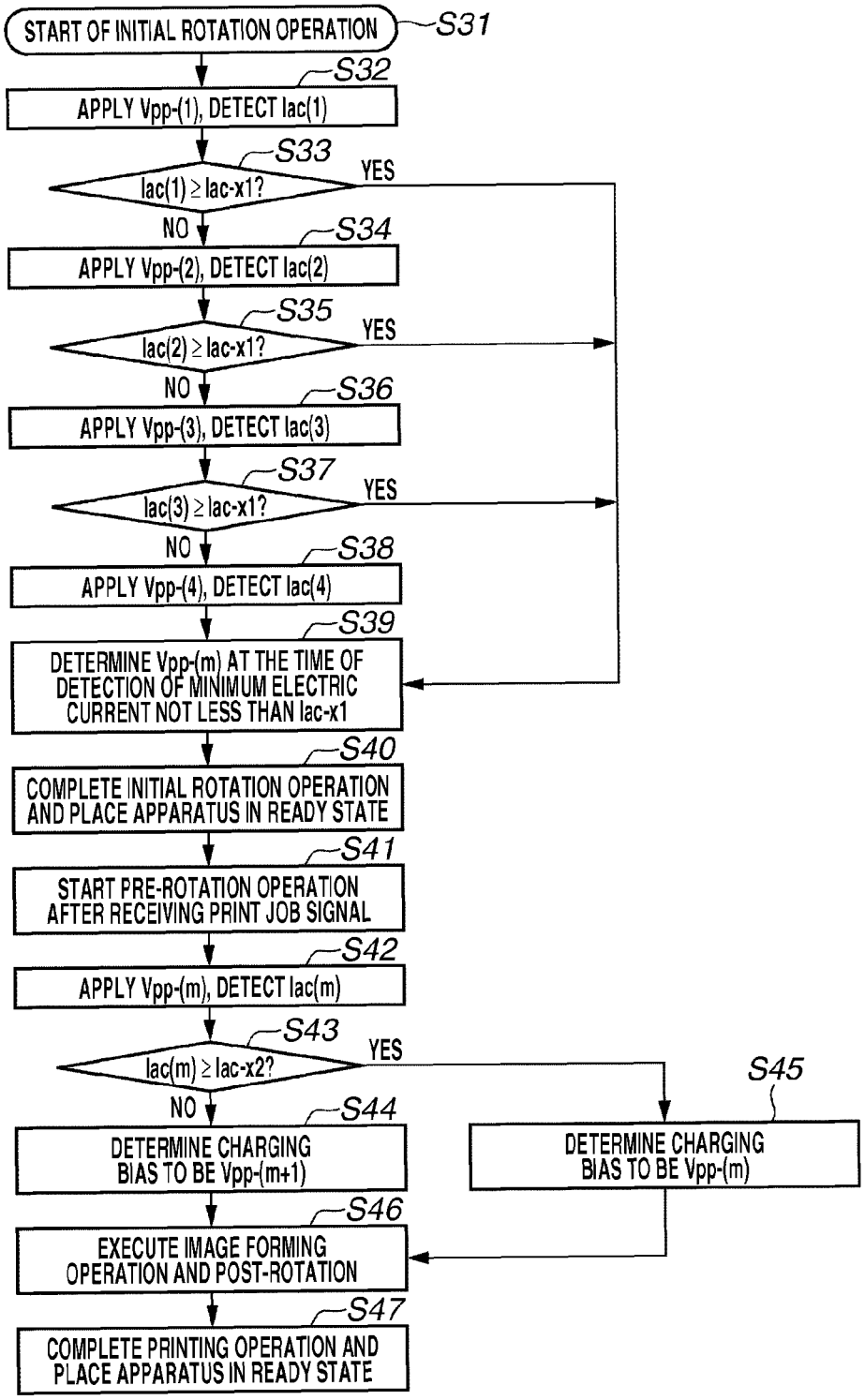
FIG. 7 is a flowchart illustrating a charging bias determining sequence to be performed from the turning-on of the power source to the completion of image formation according to a second exemplary embodiment.

The control performed up to the determination of the charging bias for the image formation will be described with reference to the flowchart of FIG. 7. The control operations in steps S31 to S41 correspond to those of steps S1 to S11 according to the first exemplary embodiment, and they are the same operations, so that a description thereof will not be repeated. As in the first exemplary embodiment, also in the second exemplary embodiment, the driving speed at the time of image formation may be either V×1 or V×2. Here, the case where the speed V×2, which is the driving speed at the time of normal image formation, is adopted, will be described. Also in the case of the driving speed V×1, the same control is performed except that the reference current value is Iac-x1.

In step S42, after the start of the initial rotation operation, the peak-to-peak voltage Vpp-(m) is applied, and the alternating current Iac(m) flowing at that time is measured. Then, in step S43, it is compared with the reference current value Iac-x2. When, in step S45, Iac(m)≥Iac-x2, the charging bias at the time of image formation is determined to be the peak-to-peak voltage Vpp-(m). When, in step S44, Iac(m)<Iac-x2, the charging bias applied at the time of image formation is determined to be the peak-to-peak voltage Vpp-(m+1). After this, in steps S46, image forming operation is performed, and the printing is completed in step S47.

Here, when Iac(m)<Iac-x2, the alternating-current voltage at the time of image formation is determined to be the peak-to-peak voltage Vpp-(m+1), which is equal to or greater than the peak-to-peak voltage Vpp (m). In addition, when Iac(m) <Iac-x2, the alternating-current voltage at the time of image formation may be uniformly determined to be the highest peak-to-peak voltage Vpp-(4). For, the peak-to-peak voltage Vpp-(4) is a peak-to-peak voltage set so as not to involve occurrence of faulty charging in any case. However, it has a problem in that the service life of the drum is adversely affected as the peak-to-peak voltage increases.

According to the present exemplary embodiment, it is possible to provide an image forming apparatus capable of preventing occurrence of faulty charging even when a single kind of peak-to-peak voltage Vpp is applied during the pre-rotation. As compared with the first exemplary embodiment, only one kind of peak-to-peak voltage Vpp is applied during the pre-rotation, so that the accuracy with which the desired peak-to-peak voltage is obtained is lower in the second exemplary embodiment than in the first exemplary embodiment. However, since it is only necessary to apply one kind of peak-to-peak voltage Vpp during the pre-rotation, it is possible to suppress as much as possible an increase in the requisite time for the pre-rotation.

According to the first and second exemplary embodiments described above, it is possible to provide an image forming apparatus capable of applying an appropriate charging voltage while keeping the period of time up to the image output as short as possible even in a case where the driving speed of the image bearing member during the initial rotation at the time of turning-on of the power source is lower than the driving speed thereof at the time of image formation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-013202 filed Jan. 25, 2012, which is hereby incorporated by reference herein in its entirety.

What is claimed is:

1. An image forming apparatus configured to form an image on a recording material, the image forming apparatus comprising:

an image bearing member;

a charging device configured to contact the image bearing member;

a power source capable of outputting a plurality of alternating-current voltages differing in peak-to-peak voltage and configured to apply a voltage obtained by superimposing an alternating-current voltage and a direct-current voltage on each other to the charging device; and a control unit configured to execute an initial rotating operation to rotate the image bearing member in a first speed before the image bearing member becomes a ready state in which rotation of the image bearing member is stopped, and execute a preparatory rotating operation to rotate the image bearing member in a same speed as a speed during image formation after the image forming apparatus is released from the ready state and before the image forming apparatus starts image formation, wherein the control unit performs first control during said initial rotating operation to cause the power source to apply at least one alternating-current voltage of the plurality of alternating-current voltages to the charging device and to detect a value of current flowing through the image bearing member, wherein when the image bearing member is to be rotated at a second speed higher than the first speed during the preparatory rotating operation, the control unit performs second control during the preparatory rotating operation to cause the power source to apply at least one alternating-current voltage to the charging device, and, to detect a value of current flowing through the image bearing member, and to determine a peak-to-peak voltage of an alternating-current voltage to be applied to the charging device at the time of image formation based on the detected current value in the second control, wherein a peak-to-peak voltage of an alternating-current voltage applied to the charging device in the second control is determined according to the current value detected in the first control.

2. The image forming apparatus according to claim 1, wherein, when a threshold value current that is predetermined according to the first speed is referred to as a first threshold value current, and the alternating-current voltage obtained when the current value detected in the first control is equal to or greater than a value of the first threshold value current and is a minimum current value is referred to as a peak-to-peak voltage Vpp(m), the control unit determines the alternating-current voltage to be applied to the charging device in the second control based on the peak-to-peak voltage Vpp(m).

3. The image forming apparatus according to claim 2, wherein a peak-to-peak voltage of the alternating-current voltage first applied to the charging device in the second control is lower than the peak-to-peak voltage Vpp(m).

4. The image forming apparatus according to claim 3, wherein, when, out of the plurality of alternating-current voltages outputtable by the power source, an alternating-current voltage whose peak-to-peak voltage is one step lower than the peak-to-peak voltage Vpp(m) is referred to as a peak-to-peak voltage Vpp(m−1), the alternating-current voltage first applied to the charging device in the second control is the peak-to-peak voltage Vpp(m−1).

5. The image forming apparatus according to claim 2, wherein the alternating-current voltage first applied to the charging device in the second control is the peak-to-peak voltage Vpp(m).

6. The image forming apparatus according to claim 2, wherein the control unit successively increases a peak-to-peak voltage of the alternating-current voltage to be applied to the charging device in the first control, and stops increasing the peak-to-peak voltage at a point in time when the detected current value becomes equal to or greater than a value of the first threshold value current.

7. The image forming apparatus according to claim 1, wherein, when a threshold value current predetermined according to the second speed is referred to as a second threshold value current, the control unit causes the power source to apply a plurality of alternating-current voltages differing in peak-to-peak voltage to the charging device in the second control, and determines a peak-to-peak voltage of the alternating-current voltage applied to the charging device at the time of image formation based on the alternating-current voltage obtained when the current value detected in the second control is equal to or greater than a value of the second threshold current and when a minimum current value is detected.

8. The image forming apparatus according to claim 1, wherein, when a threshold value current predetermined according to the second speed is referred to as a second threshold value current, and when an alternating-current voltage is first applied to the charging device in the second control, if the detected current value is less than a value of the second threshold value current, the control unit makes the peak-to-peak voltage of the alternating-current voltage applied to the charging device for the second time in the second control higher than the peak-to-peak voltage of the alternating-current voltage first applied to the charging device in the second control.

9. The image forming apparatus according to claim 1, wherein, when a threshold value current predetermined according to the second speed is referred to as a second threshold value current, and when an alternating-current voltage is first applied to the charging device in the second control, if the detected current value is greater than a value of the second threshold value current, the control unit makes the peak-to-peak voltage of the alternating-current voltage applied to the charging device for the second time in the second control lower than the peak-to-peak voltage of the alternating-current voltage first applied to the charging device in the second control.

10. The image forming apparatus according to claim 1, wherein, when a threshold value current predetermined according to the second speed is referred to as a second threshold value current, the control unit causes the power source to apply a plurality of alternating-current voltages differing in peak-to-peak voltage to the charging device in the second control, and wherein, when all the current values detected in the second control do not become greater than a value of the second threshold value current, the control unit causes the power source to apply an alternating-current voltage having a peak-to-peak voltage still higher than the highest peak-to-peak voltage applied to the charging device in the second control to the charging device at the time of image formation.

11. The image forming apparatus according to claim 1, wherein, when a threshold value current predetermined according to the second speed is referred to as a second threshold value current, the control unit causes the power source to apply an alternating-current voltage to the charging device in the second control, wherein, when the current value detected in the second control is equal to or greater than a value of the second threshold value current, the control unit causes the power source to apply the alternating-current voltage applied in the second control to the charging device also at the time of image formation, and wherein, when the current value detected in the second control is less than the value of the second threshold current, the control unit causes the power source to apply an alternating-current voltage having a peak-to-peak voltage higher than the peak-to-peak voltage of the alternating-current voltage applied to the charging device in the second control to the charging device at the time of image formation.

12. The image forming apparatus according to claim 1, wherein the control unit is capable of selecting between the first speed and the second speed as the speed of the image bearing member at the time of image formation.

13. The image forming apparatus according to claim 12, wherein the control unit determines the speed of the image bearing member at the time of image formation based on a kind of the recording material.

14. The image forming apparatus according to claim 12, wherein, when rotating the image bearing member at the first speed at the time of image formation, the control unit performs third control to cause the power source to apply an alternating-current voltage to the charging device, to detect a value of the current flowing through the image bearing member while causing the image bearing member to make a rotation at the first speed from reception of a signal designating image formation to start of image formation, and to determine a peak-to-peak voltage of the alternating-current voltage applied to the charging device at the time of image formation based on the detected current value, and wherein, in the third control, the peak-to-peak voltage of the alternating-current voltage applied to the charging device is changed based on the current value detected in the first control.

15. The image forming apparatus according to claim 14, wherein, when rotating the image bearing member at the first speed at the time of image formation, when a threshold value current predetermined according to the first speed is referred to as a first threshold value current, the control unit determines a peak-to-peak voltage of the alternating-current voltage applied to the charging device at the time of image formation based on the alternating-current voltage obtained when the current value detected in the third control is equal to or greater than the value of the first threshold value current and when a minimum current value is detected.

16. The image forming apparatus according to claim 1, wherein a number of alternating-current voltages applied to the charging device in the second control is less than a number of alternating-current voltages applied to the charging device in the first control.

17. The image forming apparatus according to claim 1, wherein a frequency of the alternating-current voltage applied to the charging device in the first control is lower than a frequency of the alternating-current voltage applied to the charging device in the second control.

18. The image forming apparatus according to claim 1, wherein the charging device includes a charging roller configured to rotate while contacting the image bearing member, and wherein the current value detected in the first control and the second control is an average value of electric current flowing through the image bearing member while the charging roller makes one rotation or more.

19. The image forming apparatus according to claim 1, wherein the control unit performs the first control before the image forming apparatus comes into a standby state after the image forming apparatus is powered on.

20. The image forming apparatus according to claim 1, wherein the control unit performs the second control before image formation is started after a signal designating image formation is received.

* * * * *